US006454633B1

(12) United States Patent
Reinhardt et al.

(10) Patent No.: US 6,454,633 B1
(45) Date of Patent: Sep. 24, 2002

(54) POLISHING PADS OF FLOCKED HOLLOW FIBERS AND METHODS RELATING THERETO

(75) Inventors: Heinz F. Reinhardt, Chadds Ford, PA (US); Elmer W. Jensen, Jr., Chadds Ford, PA (US)

(73) Assignee: Rodel Holdings Inc., Wilmington, DE (US)

( * ) Notice: Subject to any disclaimer, the term of this patent is extended or adjusted under 35 U.S.C. 154(b) by 0 days.

(21) Appl. No.: 09/599,116

(22) Filed: Jun. 22, 2000

Related U.S. Application Data

(63) Continuation-in-part of application No. 09/055,198, filed on Apr. 4, 1998, now abandoned.
(60) Provisional application No. 60/043,405, filed on Apr. 4, 1997.

(51) Int. Cl.[7] ..... B24B 1/00
(52) U.S. Cl. ..... 451/36; 451/41; 451/59; 451/527; 451/532
(58) Field of Search ..... 451/36, 41, 56, 451/59, 526, 527, 532, 550; 51/296, 298

(56) References Cited

U.S. PATENT DOCUMENTS

| | | | | |
|---|---|---|---|---|
| 3,666,695 | A | | 5/1972 | Jachimowicz et al. |
| 3,772,132 | A | | 11/1973 | Dullin, Jr. |
| 4,086,068 | A | | 4/1978 | Hedin |
| 4,291,508 | A | | 9/1981 | Prunier |
| 4,476,186 | A | * | 10/1984 | Kato |
| 4,693,840 | A | | 9/1987 | Trinh et al. |
| 4,728,552 | A | | 3/1988 | Jensen, Jr. |
| 4,753,838 | A | | 6/1988 | Kimura et al. |
| 4,879,969 | A | | 11/1989 | Haranoya et al. |
| 5,000,761 | A | | 3/1991 | Mayton et al. |
| 5,104,421 | A | | 4/1992 | Takizawa et al. |
| 5,569,521 | A | | 10/1996 | Francoeur, Sr. et al. |
| 5,815,876 | A | | 10/1998 | Overseth |

* cited by examiner

*Primary Examiner*—Timothy V. Eley
(74) *Attorney, Agent, or Firm*—Konrad Kaeding; Gerald K. Kita; Kenneth A. Benson

(57) ABSTRACT

A polishing pad is provided which is comprised of vertically oriented hollow fibers. Such pads can be produced by electrostatically flocking fibers onto a substrate.

9 Claims, 1 Drawing Sheet

POLISHING PADS OF FLOCKED HOLLOW FIBERS AND METHODS RELATING THERETO

This application is a Continuation-in-Part of application Ser. No. 09/055,198 filed Apr. 4, 1998 now abandoned which claims the benefit of U.S. Provisional Application No. 60/043,405 filed on Apr. 4, 1997.

BACKGROUND OF THE INVENTION

1. Field of the Invention

The present invention relates to polishing pads used for creating a smooth, ultra-flat surface on such items as glass, semiconductors, dielectric/metal composites and integrated circuits.

2. Description of Related Art

Polishing generally consists of the controlled wear of an initially rough surface to produce a smooth specular finished surface. This is commonly accomplished by rubbing a pad against the surface of the article to be polished (the workpiece) in a repetitive, regular motion while a solution containing a suspension of fine particles (the slurry) is present at the interface between the polishing pad and the workpiece.

Polishing pads are normally produced by impregnation of felt with polymer solutions using water miscible solvents such as DMF followed by coagulation with water or water solvent blends, then drying and buffing or splitting/buffing. In another process the polymer solution is coated onto a substrate followed by coagulating. This process leads to the formation of vertically oriented pores (VO pores) which serve as slurry reservoir during polishing. The impregnation/coagulating method gives material with mostly horizontally oriented fibers and the coating method results in a coating without any fiber reinforcement except the fibers present in the substrate. The only way to make polishing material with vertically oriented fibers is by laminating horizontally oriented product to make a vertically oriented product such as described in U.S. Pat. No. 4,728,552.

A patent which shows one method of forming a polishing sheet material with pores on the surface to provide slurry reservoir is U.S. Pat. No. 4,753,838. The pad surface is made of cellular polyurethane.

SUMMARY OF THE INVENTION

A polishing pad is provided which is comprised of vertically oriented hollow fibers. Such pads can be produced by electro statically flocking fibers onto a substrate. Optionally, the pad comprised of vertically oriented hollow fibers may be coated with a polymer solution to fill the voids between the fibers. The surface of pads coated with a polymer solution may be abraded or skived to remove polymer skin and open the hollow fiber ends.

A method for polishing a workpiece is provided wherein polishing pads as described above are used to planarize a workpiece by contacting the surface of the polishing pad and a surface of the workpiece while there is motion between the polishing pad and the workpiece.

DETAILED DESCRIPTION OF THE INVENTION

A process has been developed to make polishing pads containing vertically oriented hollow fibers by electrostatically flocking fibers vertically onto substrates. The material may then be coated with polymer solution to fill the voids between the fibers. No polymer coating/impregnation may be needed if the fibers are flocked very densely. Any type of hollow or multichannel fibers may be used, such as hollow polyester, nylon, and carbon fibers, all of which are commercially available. This results in surface structures with increased slurry reservoir. Hollow polyester and nylon fibers are commercially available as well as higher denier triocular and tetraocular nylon (Tynex, a trademark of the DuPont Company). Hollow fiber felts made by electrostatic flocking and used for the impregnation/coagulating process give polishing surfaces with vertically oriented hollow fibers which act as slurry reservoir by themselves or in combination with the pores generated during coagulation. This process results in a new type of polishing pad which not only has vertically oriented fiber reinforcement but also has increased slurry uptake because of the hollow nature of the fiber used.

Figure 1:
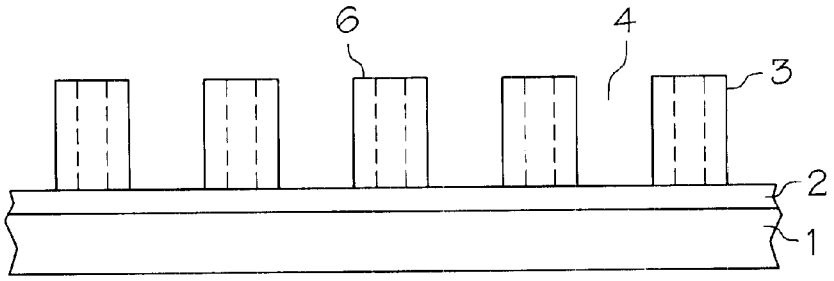
FIG. 1 is a side cross sectional view of a portion of a polishing pad comprising vertically flocked hollow fibers.
Figure 2:
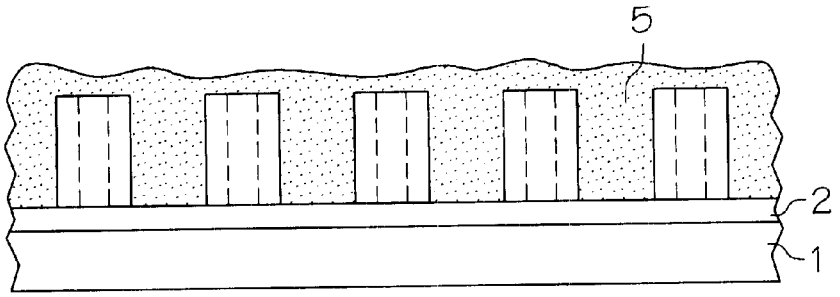
FIG. 2 is a side cross sectional view of a pad as shown in FIG. 1 wherein a polymer has been coated onto the pad to fill the voids between fibers.
Figure 3:
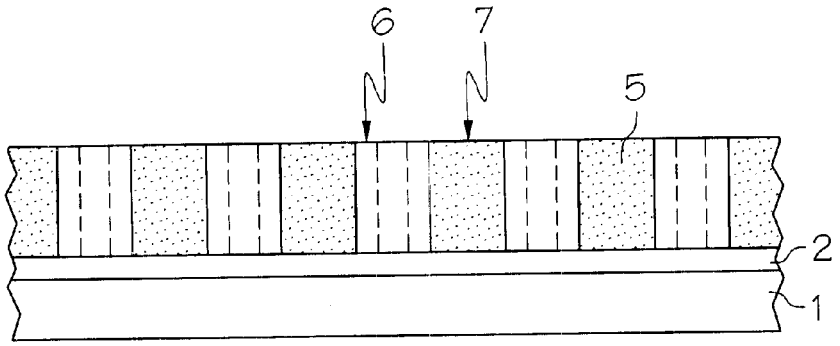
FIG. 3 is a side cross sectional view of a pad as shown in FIG. 2 wherein the polymer coating has been removed from the surface of the pad.

FIGS. 1, 2, and 3 clearly show the pads of this invention. FIG. 1 shows fibers 3 which have been flocked vertically onto adhesive layer 2 on substrate 3. The Figures show cylindrical hollow fibers, however, they may be of any shape and have any number of hollow passageways. FIG. 1 shows considerable void space 4 between the fibers 3. The fibers may be densely flocked so that there is very little void space between fibers and polymer impregnation is not necessary. The hollow fiber ends 6 would then provide the surface of the polishing pad.

FIG. 2 shows that, if there is void space between the fibers, a polymer 5 may be coated onto the fibers so that the void spaces are filled and the resulting polishing pad has a more complete surface. Polymers which may be used for coating the pad surface are a polyurethane, polyurea, polyacrylate, polymethacrylate, polysulfone, polyacrilonitile, polystyrene, polybutadiene, fluorine and chlorine containing polymer, and copolymers or blends of any of the mentioned polymers. Most preferred is a polyurethane.

The surface of the polymer coating may be skived or abraded to give a polishing pad surface 7 which is planar. As shown in FIGS. 2 and 3 the polymer coating does not enter the small hollow portions of the vertical fibers. After abrading the top surface of the pad, these hollow ends exposed on the surface of the pad are open to receive slurry or polishing fluid. Also the polymer coating on coagulation on the surface and in the voids of the flocked hollow fibers may have small voids which can provide further slurry reservoir on the surface of the pad.

A variety of samples were prepared by flocking solid and one- or multichannel fibers electro statically onto substrates with most of the fibers vertically oriented. The fiber flock used was usually between 0.4 to 0.8 mm in length. Hollow fibers used in the experiments included hollow polyester and 3- and 4- channel nylon. Some samples were coated with polyurethane solutions to fill the voids between the fibers. The coagulated material was abraded by sanding to remove the skin and to open the hollow fiber ends and pores in the polymer.

Fibers flocked onto a polymer film or onto a foamed backing (such as foamed rubber) provided surfaces which would make excellent pads for chemical mechanical planarization. The surface was very uniform and choice of backing material makes it possible to obtain the desired stiffness or resilience for a given polishing operation.

Electrostatic flocking of short, high denier fibers is a well known art. Any type of adhesive may be used to adhere the vertically oriented fibers to a substrate. The adhesive may be a hot melt, aqueous based, or solvent based. For the purpose of making the surface layer of a pad useful for chemical mechanical polishing of a workpiece, such as a semiconductor wafer, the adhesive needs to be resistant to water and alkaline conditions up to a pH of 12. Since polyurethanes are commonly used in the manufacture of pads for chemical mechanical polishing, they are a preferred material for the flocking process adhesive.

Pads of this invention are particularly useful for the planarization of semiconductor wafers. Such planarization is carried out using a polishing fluid, such as a slurry. During polishing, the polishing fluid is placed between the pad's polishing surface and the substrate, such as a semiconductor wafer. As the pad is moved relative to the substrate being polished, the substate is planarized. Improved flow of polishing fluid generally allows for more efficient and effective polishing performance.

The scope of the invention is limited only by the claims which follow.

What is claimed is:

1. A method of polishing a workpiece comprising the steps of:

providing a polishing pad having hollow fibers as reservoirs for a slurry, and providing open ends of the hollow fibers at a surface of the polishing pad to present the slurry at an interface of the surface of the polishing pad and the workpiece while polishing the workpiece with the slurry and with the surface of the polishing pad.

2. A polishing pad for polishing a workpiece by polishing with a surface of the polishing pad and with a slurry, the polishing pad comprising: a substrate, and multiple hollow fibers between the substrate and the surface of the polishing pad, the hollow fibers having open ends exposed at the surface of said polishing pad, the hollow fibers providing reservoirs for the slurry, and the open ends presenting the slurry at an interface of the surface of the polishing pad and the workpiece.

3. The polishing pad as recited in claim 2, and further comprising: polymer in voids between the fibers.

4. The polishing pad as recited in claim 2, and further comprising: polymer in voids between the fibers, the polymer having pores providing additional reservoirs for the slurry.

5. The polishing pad as recited in claim 2, and further comprising: polymer in voids between the fibers, the polymer extending to the surface of the polishing pad, and the surface of the polishing pad being abraded.

6. A method of making a polishing pad, comprising the steps of:

attaching multiple hollow fibers to a substrate of the polishing pad, extending the hollow fibers from the substrate of the polishing pad to a surface of the polishing pad, providing the hollow fibers as reservoirs for a slurry, and providing open ends of the hollow fibers at the surface of the polishing pad to present the slurry at an interface of the surface of the polishing pad and a workpiece to be polished by the surface of the pad and by the slurry.

7. The method of making a polishing pad as recited in claim 6, and further comprising the step of: providing polymer in voids between the fibers.

8. The method of making a polishing pad as recited in claim 6, and further comprising the steps of: providing polymer in voids between the fibers, and filling the voids with polymer to the surface of the polishing pad.

9. The method of making a polishing pad as recited in claim 6, and further comprising the steps of: providing polymer in voids between the fibers, filling the voids with polymer to the surface of the polishing pad, and abrading the polymer at the surface of the polishing pad.

* * * * *